United States Patent [19]

Daebler et al.

[11] 4,138,018

[45] Feb. 6, 1979

[54] APPARATUS AND METHOD FOR SORTING SUBSTRATES

[75] Inventors: Donald H. Daebler; John H. Morgan, both of Albuquerque, N. Mex.

[73] Assignee: GTE Automatic Electric Laboratories, Inc., Northlake, Ill.

[21] Appl. No.: 804,960

[22] Filed: Jun. 9, 1977

[51] Int. Cl.[2] ..... B07B 13/04; B07C 5/04

[52] U.S. Cl. ..... 209/633; 209/920; 209/678; 209/679; 209/702

[58] Field of Search ..... 209/75, 82, 80, 97

[56] References Cited

U.S. PATENT DOCUMENTS

| | | | |
|---|---|---|---|
| 1,363,818 | 12/1920 | Scott | 209/90 |
| 2,755,929 | 7/1956 | Prenveille | 209/99 |

*Primary Examiner*—Allen N. Knowles

*Attorney, Agent, or Firm*—Russell A. Cannon

[57] ABSTRACT

A substrate grader accepts or rejects a substrate depending upon the degree of warp and then sorts the accepted substrates according to a dimension thereof. The grader comprises a first plate which is U-shaped and inclined at an acute angle with respect to the horizontal, the two arms of the first plate extending above the base thereof. A first elongated member (or lower guide) that is attached to the front of the base has a straight side which is adjacent to and spaced a short distance away from the opening in the first plate. A second elongated member, that is attached to the back of the free ends of the arms, supports a second plate (or upper guide) thereon which extends between the arms, which has a top surface in a plane containing the top surfaces of the arms and base, and which has a stepped edge in the opening. Successive stepped surfaces of this edge are parallel to and spaced progressively farther from the straight surface of the first member such that rectangular substrates contacting these spaced apart surfaces may fall through an opening therebetween to be sorted according to ranges of the length thereof. A pair of flat plates that are supported a prescribed distance above one arm receive substrates therebetween for measuring warp in the substrates. The first plate is mounted on a vibrator which causes substrates to move across this plate.

10 Claims, 5 Drawing Figures

APPARATUS AND METHOD FOR SORTING SUBSTRATES

BACKGROUND OF INVENTION

This invention relates to gauges for inspecting parts which are generally flat and rectangularly shaped to insure that dimensions thereof are within prescribed limits and more particularly to a gauge for sorting dielectric substrate blanks into groups according to the magnitudes of the broad dimensions thereof.

Resistive and conductive patterns of hybrid circuits are formed by thick film techniques on thin rectangularly shaped dielectric substrates such as high purity alumina ceramic. A number of different printing operations must be performed sequentially on the substrates to produce these patterns on them. It is important that patterns produced during each operation be accurately located on the substrates. In order to achieve the desired accuracy, registry is normally made on the periphery of the substrates during each operation. Also, each operation is set to be performed on substrates having only specified lengths and widths that are within specified tolerances that are small. It is desirable therefore that the broad dimensions and warp of the substrate be carefully controlled. It is impractical, however, to set such tight manufacturing tolerances on substrates as would be required by these operations. It is therefore necessary to measure the length and width and warp of each substrate and to sort them into groups having different dimensional ranges. The various printing operations can then be performed first on one group and then on another group of substrates. The major dimensions and warp of substrates have previously been measured individually with handheld instruments in order to sort them into groups. Such a technique is time consuming. An object of this invention is the provision of improved semiautomated apparatus and method for more efficiently measuring and sorting substrates into groups according to ranges of dimensions thereof.

SUMMARY OF INVENTION

In accordance with this invention, apparatus for sorting substrates, having first and second spaced apart points in a given line on one edge of the substrate and having a third point spaced apart farthest from the given line in a given plane containing the three points, into groups according to magnitudes of at least the length of the substrates between the given line and the third point, comprises: support means for supporting a substrate for movement in one horizontal direction in a first plane that is inclined at an angle of less than 90° with respect to the horizontal, said support means having a plurality of fourth points arranged in a first pattern in the first plane, fourth points defining at least one first line in the first plane for contacting one broad side of a substrate for supporting the latter, a plurality of fifth points arranged in a second longitudinal pattern in the first plane for contacting the one broad side of a substrate, said fifth points being spaced below said fourth points for defining an opening therebetween, and a plurality of sixth points arranged in a third pattern in a second plane that intersects the first plane at an angle, some sixth points being arranged in at least one second line that is parallel to the first line for contacting the one edge of a substrate, said second plane extending upward from said first plane and intersecting the latter in a third line that is adjacent to and spaced below said fifth points on the side thereof that is spaced away from said fourth points, sixth points contacting the one edge of a substrate cooperating with fourth and fifth points contacting the one broad side thereof for supporting the one broad side of the substrate in the first plane, the spacing between fourth and sixth points contacting the broad side and the one edge, respectively, of a substrate located thereon periodically increasing in a stepwise manner in the one direction such that when the length of a substrate is less than this spacing then the substrate falls through the associated opening between the fourth and fifth points; and means for moving a substrate in the one direction in the first plane with the bottom edge contacting sixth points in the second plane and at least some fourth and/or fifth points contacting the one broad side of the substrate for sorting the latter.

DESCRIPTION OF THE DRAWINGS

This invention will be more fully understood from the following detailed description thereof, reference being had to the attached drawings in which.

DESCRIPTION OF PREFERRED EMBODIMENTS

Figure 1:
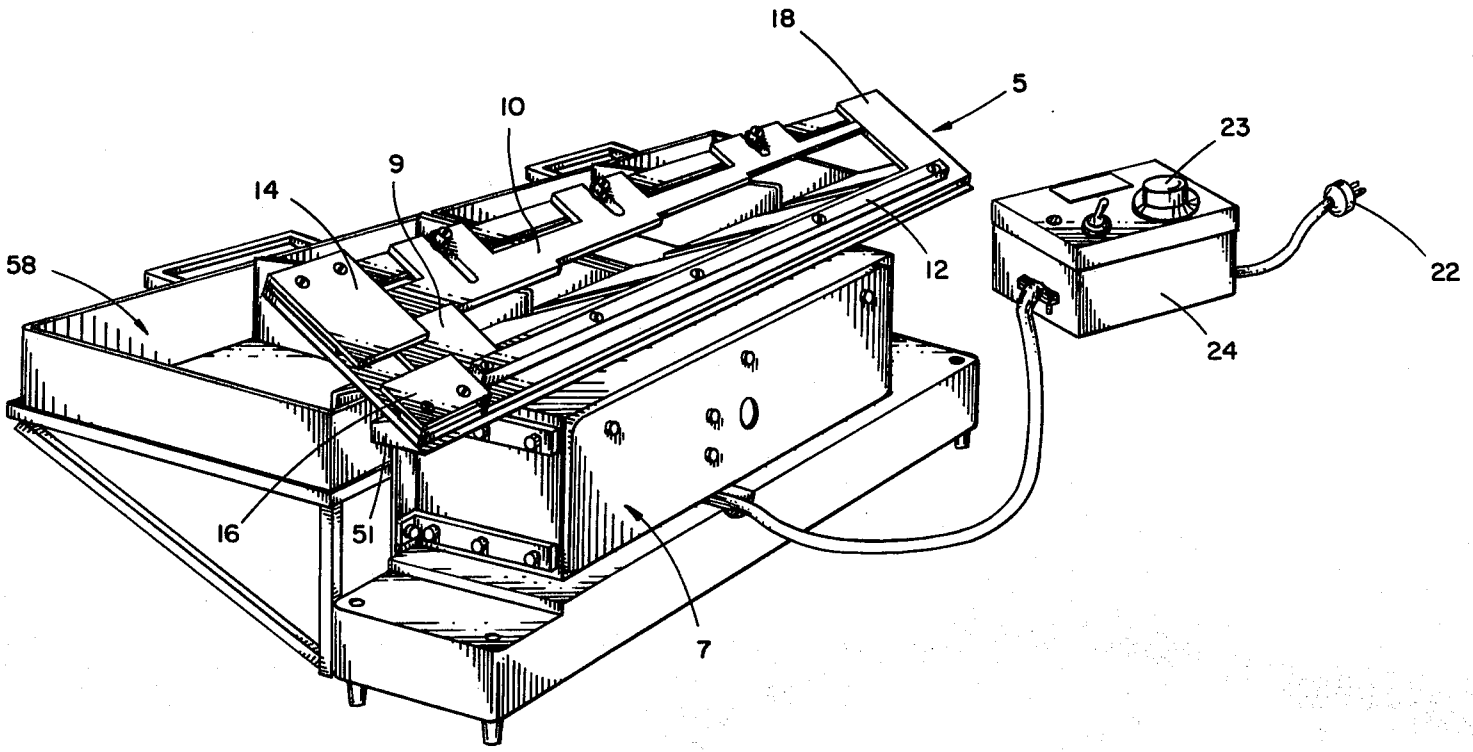
FIG. 1 is a perspective view of apparatus embodying this invention.

Referring now to FIG. 1, a preferred embodiment of this invention comprises support structure 5 mounted on a vibrator 7. The structure 5 comprises a movable upper guide 10, a fixed lower guide 12, and a pair of flat plates 14 and 16 that are secured to a U-shaped support plate 18. The plates 14, 16 and 18 cooperate to operate as a gauge which is useful in measuring the degree of warp in a ceramic substrate 9. the plate 18 and guides 10 and 12 cooperate to operate as a go/no-go gauge for measuring the height of substrates 9. The vibrator 7 is a commercially available device which vibrates slower in the left-to-right direction than in the return direction. It is energized by connecting the plug 22 to an AC power source (not shown). The potentiometer 23 on the control box 24 is varied to adjust the rate at which the vibrator 7 operates. If a substrate 9 passes through the opening between plates 14 and 16 and the support plate 18 (see FIG. 3), then the operation of the vibrator 7 causes the substrate to move from left-to-right along the lower guide 12 in FIG. 1.

Figure 4:
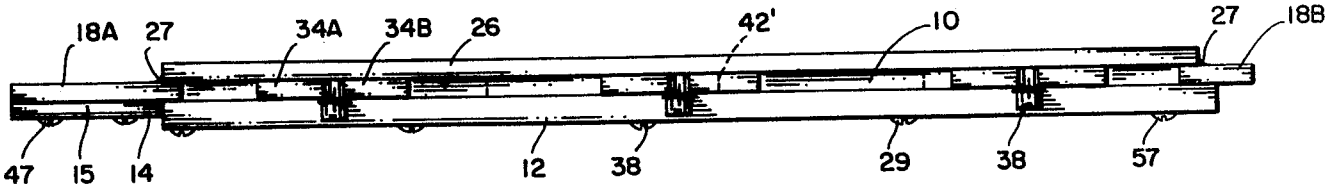
FIG. 4 is a top-elevation view of the support structure 5 in FIG. 2 rotated 90° clockwise and looking in the direction of the arrows 4—4.
Figure 2:
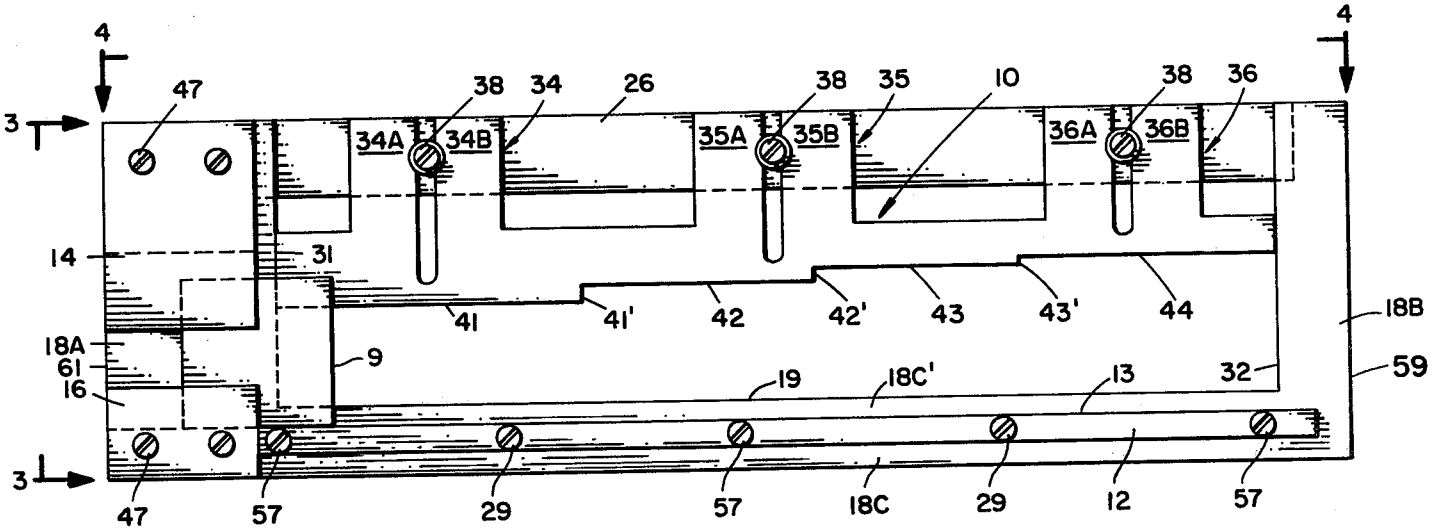
FIG. 2 is an enlarged plan view of the support structure 5, separated from the vibrator 7 and block 51 in FIG. 1.
Figure 3:
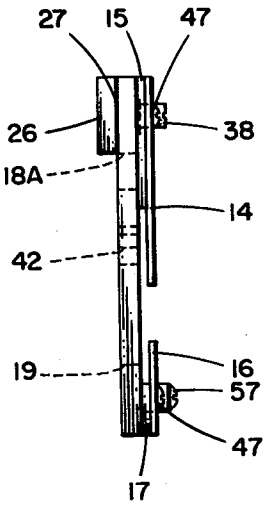
FIG. 3 is a side-elevation view of the support structure 5 in FIG. 2, with the substrate 9 removed therefrom, looking in the direction of the arrows 3—3.

The support plate 18 has a pair of arms 18A and 18B and a base 18C, the top and bottom surfaces of plate 18 preferably being flat and parallel (see FIGS. 2 and 3). A flat bar 26 extends across the opening in plate 18 and is welded at lines 27 to the underside of the arms 18A and 18B adjacent to the free ends thereof (see FIG. 4). The lower guide 12 is a rectangularly shaped bar which is attached to base 18C by screws 29. It extends beyond the two edges 31 and 32 of the opening in plate 18. The upper surface 13 of guide 12 is flat and spaced slightly below the edge 19 of the base 18C in order to establish a narrow ledge 18C' adjacent to the lower guide (see FIG. 2).

The upper guide 10 is located in the opening in plate 18 and has fingers 34, 35 and 36 extending over the welded bar 26. Screws 38 extend through slots in associated fingers of guide 10 and are threaded into holes in the bar 26 to hold the upper guide in a desired position. The top and bottom surfaces of the upper guide are also preferably flat and parallel. Further, the thickness of guide 10 is preferably equal to that of plate 18 so that the top surfaces of these two parts are in the same plane. The length of the guide 10 is only slightly less than the spacing between the arms 18A and 18B to provide a contiguous surface therebetween. The lower edge of the upper guide has a plurality of steps formed therein over the length thereof, the surfaces 41–44 in this edge being parallel to each other.

The plates 14 and 16 are secured over associated shims 15 and 17 to the left-arm 18A of the plate 18 by screws 47. The shims 15 and 17 have top and bottom surfaces that are flat and parallel. The thicknesses of the shims are only slightly greater than the thickness of substrates 9 that are to be measured for warp. By way of example, the shims 15 and 17 may measure 0.035 inch thick for substrates that are specified to be 0.025 inch ± 0.0015 inch thick with a warp of less than 0.010 inch.

Figure 5:
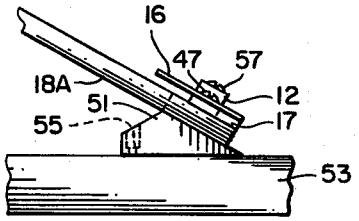
FIG. 5 is a side-elevation view of a portion of the apparatus in FIG. 1.

In order to mount the plate 18 on the vibrator 7 at an angle in the order of approximately 30° to the horizontal, an elongated bar 51 that is generally triangularly shaped is first attached to the top 53 of the vibrator by screws 55 in counter sunk holes in the bar 51 (see FIG. 5). The plate 18 is then located on the bar 51 and screws 57 are passed through holes in the lower guide 12 and plate 18 and threaded into openings in the bar 51. After the upper guide 10 is adjusted to make the edge surfaces 41–44 thereof parallel to the upper surface 13 of the lower guide 12 at prescribed distances therefrom, the screws 38 are tightened to fix the relative positions of the guides 10 and 12. This set-up may be readily accomplished with a templet or with calipers. By way of example, in apparatus for sorting substrates nominally measuring 2 inch × 2 inch × 0.100 inch thick, each of the edge surfaces 41–44 may be 3 inches long.

In apparatus that was built and successfully operated, adjacent ones of the surfaces 41–44 were spaced 0.012 inch apart. The surfaces 41 and 44 were spaced 1.982 inches and 2.018 inches, respectively, from the edge 13 of the lower guide 12. This means that a substrate having a height which is more than 0.018 inch less than the nominal value of 2.0 inches and which falls through the opening between surfaces 41 and 13 and into bin 58 can be considered a rejected part. A substrate having a height of between 1.982 inches and less than 1.994 inches will fall through the opening between the surfaces 42 and 13. In a similar manner, substrates having heights of between 1.994 inches and less than 2.006 inches and between 2.006 inches and less than 2.018 inches will fall through the opening between associated surfaces 43 and 44 and the surface 13 of the lower guide. Substrates having a height which is greater than 2.018 inches are passed over the edge 59 of plate 18 and may be considered as rejects. Thus, substrates 9 are divided into rejected parts having heights greater than or less than allowable values and into three different groups having heights which vary over ranges of 0.012 inch.

In operation, an operator inserts a substrate 9 into the opening between the upper plates 14 and 16 and plate 18 at the left of FIG. 1 to measure the degree of warp thereof. If the substrate will pass through this opening between the plates, it is pushed beyond the upper plates 14 and 16 by an operator. The bottom edge of a substrate 9 contacts the surface 13 of the lower guide while the back of this substrate rests on portions of the two surfaces of the ledge 18C' and the upper guide 10. Vibration of the machine 7 causes the substrate 9 to move from left-to-right over the length of the lower guide 12. When the height of the substrate 9 is less than the spacing between the surface 13 of the lower guide 12 and one of the surfaces 41–44 of the upper guide, the substrate falls through the opening there and into an associated tray located behind the vibrator. In this manner, substrates are sorted into groups thereof having broad dimensions which are within prescribed ranges.

Although this invention is described in relation to preferred embodiments thereof, variations and modifications thereof will occur to those skilled in the art without departing from the spirit of this invention. By way of example, the surfaces 41–44 of the upper guide may be ground at an acute angle with respect to the top surface thereof to facilitate a substrate falling through the opening between associated facing surfaces of the upper and lower guides. Also, the lower guide 12 may be welded to the plate 18 and the bar 26 may be attached to the ends of arms 18A and 18B by screws rather than welding. Although, the lower edge of the upper guide 10 is shown as stepped in the preferred embodiment of this invention, the upper surface 13 of the lower guide or both of the facing surfaces of the two guides may be stepped. Further, a structure performing the functions of the plate 18 and the upper and lower guides may be formed from a single or a plurality of metal parts. It is only necessary to provide a plurality of points in parallel line-edges corresponding to the surfaces 41–44 and spaced apart points in a line-edge corresponding to the edge 19 in a common plane which intersects a surface corresponding to the top edge 13 of the lower guide 12. Substrates can then be moved along the lower surface 13 with the broad back side of the substrate contacting the spaced apart line-edges. Additionally, the plates 14 and 16 and associated shims 15 and 17 may be omitted and the lower guide 12 extended to the left edge 61 of the arm 18A, substrates then being automatically loaded onto the left edge of the guide 12 and the arm 18A by a separate vibratory feed (not shown). Further, the plane containing the top surfaces of the upper guide 10 and base 18C may be horizontal and pressure means employed to hold the substrates against the surface 13. A conveyor with a finger contacting the left side of a substrate could then be used to move substrates across the structure 5. Also, the substrates to be sorted may be curved instead of flat or may, for example, be triangularly rather than rectangularly shaped, it only being required that there be two points in a line which contact the lower guide 12 and at least one point spaced farthest therefrom which contacts the top surface of the upper guide 10. The scope of this invention is therefor to be determined from the attached claims rather than from the above detailed description of preferred embodiments thereof.

What is claimed is:

1. Apparatus for sorting substrates into groups according to magnitudes of at least a broad dimension thereof, comprising:

a member having a base and a pair of sides which extend from the same one edge of the base in a first plane and are spaced apart for defining an opening therebetween that has a width which is greater than at least twice the width of substrates for being sorted, first surfaces of the base and sides being flat and in the first plane;

first support means for supporting the member with the first plane inclined at an angle of less than 90° with respect to the horizontal, for movement of a substrate thereon in one horizontal direction in the first plane;

a first guide secured to and extending above the first surface of the base and having one edge thereof adjacent to and spaced a prescribed distance below the one edge of the base that is adjacent the opening, the length of the first guide being greater than the shortest spacing between the sides of said member;

a second guide having a length which is at least substantially equal to the spacing between adjacent edges of the sides and having a flat top surface;

second support means for supporting the second guide in the opening between the sides with the flat top surface thereof being in the first plane and one edge thereof being adjacent to and spaced from the one edge of the base for defining an opening therebetween;

the one edges of each of said first and second guides having at least one straight elongated line portions that are parallel to each other and the first plane, the one edge of at least one of said guides also having a plurality of straight line portions thereof in the first plane which are parallel to each other, the spacing between straight line portions of the one edges of the first and second guides contacting one edge and one broad side, respectively, of a substrate located thereon periodically increasing in a stepwise manner in the one direction such that when the length of a substrate in the direction between the guides is less than this spacing that the substrate falls through the associated opening between the one edges of the second guide and the base; and means for moving in the horizontal direction substrates having bottom edges contacting the one edge of the first guide and one broad surfaces contacting the one edge of the second guide for sorting the substrates.

2. Apparatus according to claim 1 wherein the sides of said support member extend substantially in the same direction in the first plane.

3. Apparatus according to claim 2 wherein the length of each straight line portion in the one direction and defining an individual step is greater than the width of substrates for being sorted, and the prescribed distance in the first plane between first edges of the base and first guide is less than one-half of the length of a substrate.

4. Apparatus according to claim 3 wherein the prescribed distance is substantially less than one-half the length of a substrate being sorted.

5. Apparatus according to claim 4 wherein the one edge of said first guide is in a second plane which is at least substantially perpendicular to the first plane.

6. Apparatus according to claim 5 wherein the edges of the sides which are adjacent to the opening therebetween are straight and parallel to each other and are perpendicular to the one edges of the guides.

7. Apparatus according to claim 6 wherein said moving means is a vibrator.

8. Apparatus according to claim 3 wherein the one edge of said second guide has a plurality of parallel spaced apart straight line portions defining steps therein and the one edge of said first guide is flat and in a second plane which is at least substantially perpendicular to the first plane over the length of the one edge of the first guide.

9. Apparatus according to claim 8 wherein the position of the second guide is movable for changing the spacing between straight line portions of one edges of the first and second guides.

10. Apparatus according to claim 8 wherein the position of the first guide is movable for changing the spacing between straight line portions of one edges of the first and second guides.

* * * * *